United States Patent [19]

Reim et al.

[11] Patent Number: 4,794,678

[45] Date of Patent: Jan. 3, 1989

[54] METHOD FOR THE DETERMINATION AND ELIMINATION OF VISIBLE DEFECTS IN NON WOVEN TEXTILE WEBS

[75] Inventors: Ingeborg Reim, Cottbus; Gerhard Pohl, Forst/Lausitz; Wolfgang Götzke, Forst/Lausitz; Dieter Wahnberger, Forst/Lausitz; Lothar Postel, Forst/Lausitz; Irmgard Kindlein, Forst/Lausitz; Rudolf Vatter; Manfred Greschke, both of Cottbus, all of German Democratic Rep.

[73] Assignee: VEB Forster Tuchfabriken, Forst/Lausitz, German Democratic Rep.

[21] Appl. No.: 550,269

[22] Filed: Nov. 9, 1983

[51] Int. Cl.[4] ..... D04H 18/00

[52] U.S. Cl. ..... 28/107; 364/470

[58] Field of Search ..... 28/107, 109, 115, 141; 364/470

[56] References Cited

U.S. PATENT DOCUMENTS

| | | | |
|---|---|---|---|
| 3,534,402 | 10/1970 | Crowell et al. | 364/470 |
| 3,656,177 | 4/1972 | Chung et al. | 28/107 X |
| 3,681,823 | 8/1972 | DiLo | 28/107 X |
| 3,703,752 | 11/1972 | Schulte | 28/109 |

*Primary Examiner*—Robert R. Macker
*Attorney, Agent, or Firm*—Jordan and Hamburg

[57] ABSTRACT

A method is provided for the determination and elimination of visible defects in textile webs, wherein the web is moved in the longitudinal direction over a defect seeking and registering area, and the surface position of visible defective areas, such as material deficiencies or excesses with regard to fiber components of the web are located in their surface dimension by known means during the movement of the web, as compared to the adjacent areas of the web. The defective areas are registered as a deviation from the reference condition, and the web is subsequently stopped with the defect in a position above a needle base into which felting needles are sunk. In the case of material deficiencies, the defective areas are supplied with donor material from a reserve, to control their defect by pushing the donor material into the web and stitching it to the defective area with at least two felting needles at 50 to 500 perforations per $cm^2$, In the case of material excesses, the fiber components of the excesses are pushed into the web by notches or hooks of at least two felting needles at 50 to 200 perforations per $cm^2$. Following the last perforation in the defective area, the defective web is freed for further movement at a pace relatively faster than the movement of non-aligned donor material, and is separated from the reserve by tearing or cutting.

4 Claims, No Drawings

METHOD FOR THE DETERMINATION AND ELIMINATION OF VISIBLE DEFECTS IN NON WOVEN TEXTILE WEBS

BACKGROUND OF THE INVENTION

This invention is directed to the mechanization and/or automation of heretofore manual sewing or mending processes in textile webs, preferably made of fiber yarns and/or threads with or without fiber components. The method is particularly advantageous in the elimination or concealing of defects in webs of yarns with yarn counts typical for carded and/or worsted yarns. The method is suitable for the elimination of visible defects in textile webs used, for example, for outer garments, upholstered furniture and car seat covers, as well as for other decorative materials, shoes or linens.

Sewing or mending processes or the elimination of visible defects in textile webs have been accomplished by the manual insertion of missing threads or fiber parts and/or the elimination of superfluous fibers or fiber parts following the web formation process itself. In such processes, thread, sewing or mending needles and scissors are used. Depending on the texture of the web and with a great amount of labor, the threads are arranged or pulled through at the defective places with sewing or mending needles in such a way that the differences, as compared to the arrangement of all other threads of the web, are hardly noticeable and so that a stable repairing of the web is assured. Ware or weft thread deficiencies, warp or weft thread excesses, small holes, thin places, knobs, thick places, reel places, slubs, loops and double threads are eliminated by known technology.

OBJECT OF THE INVENTION

It is the object of the invention to provide a method by which visible defects can be eliminated or concealed in textile webs, preferably in webs made of fiber yarns and/or yarns with or without fiber components, following the web formation process itself, and wherein the previously employed manual sewing or mending processes are replaced by mechanized and/or automated processes. In particular, it is the object of the invention to eliminate defects in textile webs, made of yarns with yarn counts typical for carded or worsted yarns, such as material deficiencies or excesses, for example, missing warp or weft thread parts, thin places, small holes, double threads, knobs, slubs, thick places, knots, and reel places. It is a still further object to enable a significant increase in the production of the basic material and/or repair work, as well as reduced processing combined with personnel savings and cost reductions, especially in the case of textile webs having a plain or mixed texture. The same high performance of the web is to be assured after the elimination of defects, since following sewing and mending processes, the repaired defective areas must be able to withstand subsequent outfitting and finishing processes.

DESCRIPTION OF THE NATURE OF THE INVENTION

It is the object of the invention to eliminate visible defects, such as amounts of materials, which noticeably differ from other areas of the web and/or the structure of the web, following the web formation process itself, particularly in plain and mixed webs of fiber yarns and/or yarns with or without fiber components. This is to be done by the fiber displacement with or without the inclusion of the added suitable donor material, with the orientation and classification, as well as the elimination of the various defects, being accomplished by suitable devices and their respective coordination and positioning in relationship to the defect, in a mechanized and/or automated fashion. The fiber displacement is to be as accurate as possible so that the repaired defective areas will withstand subsequent outfitting and finishing processes, with the defect remaining invisible.

The object of the invention is accomplished by repairing textile webs having visible defects in the thread pattern, following the web forming process itself by material displacement by multiple needle processes, according to known needle felting techniques. The invention is particularly directed to the repairs of plain or mixed textures with yarn counts typical for carded or worsted yarns adapted to be used, for example, for outer garments, upholstered furniture and car seat covers, decorative materials, shoes or linens.

The defective web which is to be repaired, is removed from a known unwinding device and moved in a longitudinal direction into a defect seeking and registering area, in which the defect orientation is accomplished, as well as the registering of the location and the extent of the defect. The defect is classified according to type and extent. The web is guided in its continued movement above a needle base, into which the felting-needles can be lowered (for example, in brush-form). Textile donor material is located above or below the defective web in the area of the needle base, with a fiber composition identical to the threads of the defective web, being in the form of aligned or non-aligned prereinforced fiber fleece or spinning and/or thread patterns, which can be moved in the same direction as the defective web, from a reserve and, according to the need, over the entire width of the defective web or aligned with the respective defect. The defective web can be brought to a stop in the area of the needle base, in accordance with the location of the defect. In order to remove defects which consist of an excess of material (for example, thick places or knots) as compared to adjacent areas, a multiple needling is performed on the needle base, preferably with more than one felting-needle, located in a needle device movable at least over the width of the defective web, or in a needle device arranged in a stationary position over the width of the web. The felting-needles of the needle device are movable individually or in groups in the direction of the stitches, and operate with lifting movements according to the principle of already known felting machines. Superfluous fiber components are removed from the visible area into the interior of the defective web and/or to the backside of the web with 50 . . . 200 perforations per $cm^2$ of the felting needles, until the fiber amount difference of the defective area, as compared with the adjacent areas, has been eliminated. In order to remove defects having material deficiencies (for example, warp thread deficiencies, thin places) donor material is supplied to the thread pattern and/or fiber material fleece, so that it at least conceals the defect. The donor material is brought into contact with the defective web, preferably by the use of more than one felting-needle device having 50 . . . 500 perforations per $cm^2$ of the felting needles above the needle base. The contact may be effected one or more times depending upon the extent of the defect, the process being repeated as necessary in response to instructions applied thereto. Fiber components from the donor material area are pulled by the notches or hooks of the felting needles into the interior of the defective web and to its backside. At the same time, there is a strengthening of the defective area due to the interlocking of the fibers and the fiber components as well as a strengthening of the edges of the defect. The donor area is separated from the repaired area, by an instruction for continued movement of the defective web, by the relatively faster movement of the defective web following the multiple needle process, i.e., by tearing or cutting by known cutting devices. The method can be executed by known mechanized means and manual control orders or computerized in a completely automated fashion.

EXAMPLES OF EXECUTION

The invention will be explained by means of an example: A worsted yarn web with warp and weft threads 170 tex 50% viscose fiber/50% wool of a weight per unit area of 600 g/m$^2$ is located on a controllable unwinding device, unwound therefrom and guided over a defect seeking and registering area. In this area, the visible side of the textile web is evenly illuminated over the entire width by a light source and/or illuminated by transmission of light through the web. An electro-optical sensor registers the brightness values per line of the light reflected through the upper surfaces of the textile web, by the light source arranged above the width of the web. If the brightness differences between the measured portions subdivided by the number of sensors are below an adjustable measured value, a microcomputer connected to the electro-optical sensor registers the measured web width as defect-free. If there are brightness differences between adjacent measured portions which are above the threshold value, the electro-optical sensor registers the position coordinates, the width dimension, the brightness differences, with respect to being lighter or darker than the adjacent portions, and transmits this information to the computer. The computer stores the thus arranged and brightness-classified defect image.

Immediately following the defect seeking and registering area, the textile web arrives in the area of a needle base, in which the felting needles are arranged in at least two rows over the entire material width. The needles are controlled group-like in sections, with the surface of each section corresponding with the surface of a measured section and with the width of both sections being equal. As an example, two defects were registered by the computer in several subsequent lines, with one representing material surplus and the other representing material shortage. The first defective line is guided in the needle base and the material stopped. In the portions with a shortage of material fiber fleece, material is supplied from a reserve as donor material over the width of the portions and brought into contact with the web at the defective area. The guidance of the felting needle group is accomplished at the defective areas with material shortage and material surplus via the computer so that on the one hand, the supplied donor material is needled into the web and, on the other hand, the superfluous material is pushed into the interior or to the backside of the web. The process is repeated line by line until the defects have passed the needle base. This process can be repeated as long as reasonable. Subsequently, the computer switches the transport back to continuous material passage. The donor material store is then stopped.

We claim:

1. In the method for the determination and elimination of visible defects in textile webs, wherein the web is moved as a defective web of fabric in the longitudinal direction over a defect seeking and registering area, the improvement comprising locating the surface position of visible defective areas of at least one of the types consisting of material deficiencies and excesses with regard to fiber components of the web during the movement of the web, as compared to the adjacent areas of the web, registering said defective areas as a deviation from the reference condition, stopping the defective web with the defect being above a needle base into which felting needles are sunk, subsequently supplying the defective areas of material deficiencies, with donor material from a reserve, whereby the donor material is pushed into the web and is stitched together with the fiber component of the defective areas with at least two felting needles at 50 to 100 perforations per cm$^2$, pushing the excess fiber component of the defective areas of material excesses into the web by means of at least two felting needles at 50 to 200 perforations per cm$^2$, and following the last perforation in the defective area, freeing the defective web for further movement at a pace relatively faster than the movement of the non-aligned donor material, and disjoining the defective web from the reserve.

2. The method of claim 1, wherein the donor material is at least one of a fiber fleece and thread pattern aligned in sections adjacent to at least the defective areas of the web.

3. The method of claim 1, comprising eliminating said defects in successive, separate working processes.

4. The method of claim 3, wherein the elimination of the defects is accomplished in a completely automated fashion.

* * * * *